US006796900B2

(12) United States Patent
Baerlocher et al.

(10) Patent No.: US 6,796,900 B2
(45) Date of Patent: Sep. 28, 2004

(54) GAMING DEVICE HAVING ACHIEVEMENT CRITERIA FOR ADVANCEMENT

(75) Inventors: Anthony J. Baerlocher, Reno, NV (US); Ryan William Cuddy, Reno, NV (US); Bayard S. Webb, Sparks, NV (US)

(73) Assignee: IGT, Reno, NV (US)

( * ) Notice: Subject to any disclaimer, the term of this patent is extended or adjusted under 35 U.S.C. 154(b) by 268 days.

(21) Appl. No.: 09/964,022

(22) Filed: Sep. 26, 2001

(65) Prior Publication Data

US 2003/0060255 A1 Mar. 27, 2003

(51) Int. Cl.[7] ..... A63F 9/24
(52) U.S. Cl. ..... 463/16; 273/139
(58) Field of Search ..... 463/16–17, 20–22, 463/25–27, 29–32; 273/138.1, 139, 143 R, 142 D

(56) References Cited

U.S. PATENT DOCUMENTS

| | | | |
|---|---|---|---|
| 4,695,053 | A | 9/1987 | Vazquez, Jr. et al. |
| 5,205,555 | A | 4/1993 | Hamano |
| 5,324,041 | A | 6/1994 | Boylan et al. |
| 5,342,047 | A | 8/1994 | Heidel et al. |
| 5,536,016 | A | 7/1996 | Thompson |
| 5,769,716 | A | 6/1998 | Saffari et al. |
| 5,788,573 | A | 8/1998 | Baerlocher et al. |
| 5,833,536 | A | 11/1998 | Davids et al. |
| 5,851,148 | A | 12/1998 | Brune et al. |
| 5,873,781 | A | 2/1999 | Keane |
| 5,947,820 | A | 9/1999 | Morro et al. |
| 5,964,463 | A | 10/1999 | Moore, Jr. |
| 5,980,384 | A | 11/1999 | Barrie |
| 5,984,781 | A | 11/1999 | Sunaga |
| 5,997,400 | A | 12/1999 | Seelig et al. |
| 6,004,207 | A | 12/1999 | Wilson, Jr. et al. |

(List continued on next page.)

FOREIGN PATENT DOCUMENTS

| | | |
|---|---|---|
| EP | 0945837 A2 | 9/1999 |
| WO | PCT/AU97/00121 | 9/1997 |

OTHER PUBLICATIONS

Top Dollar Brochure written by IGT, published in 1998.
Slot Line Advertisement including Temperature Rising game description written by IGT, published in 1998.
Bonus Spin Red, White & Blue Advertisement written by IGT, published date unknown.
Bingo Brochure written by Casino Data Systems, published in 1998.
Full House Brochure written by Anchor Games, published in 2000.
Jewel in the Crown Advertisement written by IGT, published in 2000.
Red Hot 7's Game Description written by IGT, game available prior to 2001.

*Primary Examiner*—Kim Nguyen
(74) *Attorney, Agent, or Firm*—Bell, Boyd & Lloyd, LLC

(57) ABSTRACT

In one embodiment, the present invention includes a gaming device having a processor and a display device connected to the processor. The display device displays a plurality of choices to a player, whereby each choice has an associated number of points. The processor provides an initial number of picks to the player. The processor also maintains a regeneration amount, whereby the player receives a new number of picks if the points associated with the player's choices accumulate at least to the regeneration amount, within the provided number of picks. In one embodiment accumulating points includes accumulating awards. If the player accumulates a predetermined goal amount of points, the player also wins a goal award.

56 Claims, 11 Drawing Sheets

U.S. PATENT DOCUMENTS 6,015,346 A 1/2000 Bennett
6,033,307 A 3/2000 Vancura
6,089,976 A 7/2000 Schneider et al.
6,102,798 A 8/2000 Bennett
6,120,031 A 9/2000 Adams
6,126,542 A 10/2000 Fier
6,126,547 A 10/2000 Ishimoto
6,135,885 A 10/2000 Lermusiaux
6,155,925 A 12/2000 Giobbi et al.
6,159,095 A 12/2000 Frohm et al.
6,159,097 A 12/2000 Gura
6,159,098 A * 12/2000 Slomiany et al. ..... 463/25
6,162,121 A 12/2000 Morro et al.
6,164,652 A 12/2000 Lauretta et al.
6,168,520 B1 1/2001 Baerlocher et al.
6,168,523 B1 1/2001 Piechowiak et al.
6,173,955 B1 1/2001 Perrie et al.
6,174,235 B1 1/2001 Walker et al.
6,190,255 B1 2/2001 Thomas et al.
6,203,429 B1 3/2001 Demar et al.
6,231,445 B1 5/2001 Acres
6,261,177 B1 7/2001 Bennett
6,270,409 B1 8/2001 Shuster
6,299,165 B1 10/2001 Nagano
6,309,300 B1 10/2001 Glavich
6,312,334 B1 11/2001 Yoseloff
6,315,660 B1 11/2001 DeMar et al.
6,315,664 B1 11/2001 Baerlocher et al.
6,328,649 B1 12/2001 Randall et al.
6,346,043 B1 2/2002 Colin et al.
6,592,457 B1 7/2003 Frohm et al.

* cited by examiner

FIG.4A

126

| 142 | |
|---|---|
| 0-15% | 4 |
| 140 -5 | 6 |
| 1 | 8 |
| 2 | 10 |
| 3 | |

FIG.4B

128

| 142 | |
|---|---|
| 16-30% | -2 |
| 140 2 | 1 |
| 3 | 4 |
| 7 | 15 |
| 20 | |

FIG.4C

130

| 142 | |
|---|---|
| 31-45% | 3 |
| 140 0 | 4 |
| 1 | 5 |
| 2 | 15 |
| 35 | |

FIG.4D

132

| 142 | |
|---|---|
| 46-60% | -2 |
| 140 -4 | 0 |
| 3 | 1 |
| 5 | 2 |
| 20 | |

FIG.4E

134

| 142 | |
|---|---|
| 61-80% | -5 |
| 140 -10 | 1 |
| 0 | 2 |
| 5 | 4 |
| 20 | |

FIG.4F

136

| 142 | |
|---|---|
| 81-100% | -2 |
| 140 -3 | 0 |
| -1 | 1 |
| 2 | 4 |
| 5 | |

FIG.5A 142 146

140

| 0-15% | |
|---|---|
| -5 | 1 |
| 3 | 2 |
| 8 | 4 |
| 10 | 6 |

| ASSOCIATED CONSOLATION AWARD | ASSOCIATED CONSOLATION AWARD SUCCESS PERCENTAGE |
|---|---|
| 85 | 15% |

144 158

FIG.5B 142 148

140

| 16-30% | |
|---|---|
| 2 | -2 |
| 3 | 1 |
| 7 | 4 |
| 20 | 15 |

| ASSOCIATED CONSOLATION AWARD | ASSOCIATED CONSOLATION AWARD SUCCESS PERCENTAGE |
|---|---|
| 70 | 30% |

144 158

FIG.5C 142 150

140

| 31-45% | |
|---|---|
| 0 | 3 |
| 1 | 4 |
| 2 | 7 |
| 35 | 15 |

| ASSOCIATED CONSOLATION AWARD | ASSOCIATED CONSOLATION AWARD SUCCESS PERCENTAGE |
|---|---|
| 55 | 45% |

144 158

FIG.5D 142 152

140

| 46-60% | |
|---|---|
| -4 | -2 |
| 3 | 0 |
| 5 | 1 |
| 20 | 2 |

| ASSOCIATED CONSOLATION AWARD | ASSOCIATED CONSOLATION AWARD SUCCESS PERCENTAGE |
|---|---|
| 40 | 60% |

144 158

FIG.5E 142 154

| 140 61-80% | |
|---|---|
| -10 | -5 |
| 0 | 1 |
| 5 | 2 |
| 20 | 4 |

| ASSOCIATED CONSOLATION AWARD | ASSOCIATED CONSOLATION AWARD SUCCESS PERCENTAGE |
|---|---|
| 25 | 75% |

144 158

FIG.5F 142 156

| 140 81-100% | |
|---|---|
| -3 | 0 |
| -1 | 1 |
| 2 | 2 |
| 5 | 4 |

| ASSOCIATED CONSOLATION AWARD | ASSOCIATED CONSOLATION AWARD SUCCESS PERCENTAGE |
|---|---|
| 15 | 85% |

144 158

FIG.7

180

170

182

| | |
|---|---|
| STAGE 1 | 90% |
| STAGE 2 | 80% |
| STAGE 3 | 65% |
| STAGE 4 | 50% |
| STAGE 5 | 35% |
| STAGE 6 | 25% |
| STAGE 7 | 15% |
| STAGE 8 | 10% |

GAMING DEVICE HAVING ACHIEVEMENT CRITERIA FOR ADVANCEMENT

CROSS REFERENCES TO RELATED APPLICATIONS

This application is related to the following co-pending commonly owned patent applications: "GAMING DEVICE HAVING A SELECTIVELY ACCESSIBLE BONUS SCHEME," Ser. No. 09/657,916, "GAMING DEVICE HAVING A BONUS ROUND WITH MULTIPLE RANDOM AWARD GENERATION AND MULTIPLE RETURN/RISK SCENARIOS," Ser. No. 09/678,989, "GAMING DEVICE HAVING BONUS SCHEME WITH INCREMENTAL VALUE DISCLOSURE," Ser. No. 09/627,198, "GAMING DEVICE WITH BONUS SCHEME HAVING MULTIPLE AWARD LEVELS," Ser. No. 09/602,140, "GAMING DEVICE HAVING A COMPETITION BONUS SCHEME," Ser. No. 09/628,144, "GAMING DEVICE HAVING A MULTIPLE SELECTION GROUP BONUS ROUND," Ser. No. 09/605,107, "GAMING DEVICE HAVING AN AWARD EXCHANGE BONUS ROUND AND METHOD FOR REVEALING AWARD EXCHANGE POSSIBILITIES," Ser. No. 09/689,510, "GAMING DEVICE HAVING A MULTI-ROUND BONUS SCHEME WHEREIN EACH ROUND HAS A PROBABILITY OF SUCCESS," Ser. No. 09/688,441, "GAMING DEVICE HAVING GRADUATING AWARD EXCHANGE SEQUENCE WITH A TEASE CONSOLATION SEQUENCE AND AN INITIAL QUALIFYING SEQUENCE," Ser. No. 09/680,601, "GAMING DEVICE WITH A BONUS SCHEME INVOLVING MOVEMENT ALONG PATHS WITH PATH CHANGE CONDITIONS," Ser. No. 09/686538, "GAMING DEVICE HAVING VALUE SELECTION BONUS," Ser. No. 09/684,605, "GAMING DEVICE HAVING RELATED MULTI-GAME BONUS SCHEME," Ser. No. 09/688,972, "GAMING DEVICE HAVING A MULTIPLE SELECTION AND AWARD DISTRIBUTION BONUS SCHEME," Ser. No. 09/688,635, "GAMING DEVICE HAVING AN ORDERED DESIGNATION OF BONUS VALUES IN MULTIPLE VALUE SETS," Ser. No. 09/978,913, "PROGRESSIVE GAMING DEVICE," Ser. No. 09/966,694, "GAMING DEVICE INCLUDING CHOICES HAVING VARYING PROBABILITIES OF CONTRIBUTING TO GAME'S TERMINATION," Ser. No. 09/957,308, "GAMING DEVICE HAVING TERMINATION VARIABLES," Ser. No. 09/966,658, "GAMING DEVICE HAVING IMPROVED AWARD OFFER BONUS SCHEME," Ser. No. 09/682,368, "GAMING DEVICE HAVING A BONUS SCHEME WITH MULTIPLE POTENTIAL AWARD SETS," Ser. No. 09/822,697, "GAMING DEVICE HAVING OFFER/ACCEPTANCE ADVANCE THRESHOLD AND LIMIT BONUS SCHEME," Ser. No. 09/838,014, "GAMING DEVICE HAVING AN OFFER AND ACCEPTANCE SELECTION BONUS SCHEME WITH A TERMINATOR AND AN ANTI-TERMINATOR," Ser. No. 09/945,082, "GAMING DEVICE HAVING AN AWARD DISTRIBUTOR AND AN AWARD ACCUMULATOR BONUS GAME," Ser. No. 09/682,369, "GAMING DEVICE HAVING MULTIPLE AWARD ENHANCING LEVELS," Ser. No. 09/967,016, and "GAMING DEVICE HAVING MULTIPLE AWARD ENHANCING LEVELS," Ser. No. 09/966,956.

COPYRIGHT NOTICE

A portion of the disclosure of this patent document contains or may contain material which is subject to copyright protection. The copyright owner has no objection to the photocopy reproduction by anyone of the patent document or the patent desclosure in exactly the form it appears in the Patent and Trademark Office patent file or records, but otherwise reserves all copyright rights whatsoever.

DESCRIPTION

The present invention relates in general to a gaming device, and more particularly to a gaming device having achievement criteria, wherein the player advances if the player meets the criteria, and the game ends if the player does not meet the criteria.

BACKGROUND OF THE INVENTION

Known gaming machines randomly generate outcomes for a player and have varying levels of player interaction. Wagering gaming machines exist having no player interaction and only a random generation. PCT application number PCT/AU97/00121 entitled, "Slot Machine Game with Roaming Wild Card," discloses a slot machine having a video display containing a plurality of rotatable reels with game symbols. When the player receives a triggering symbol or symbol combination, the game produces a bonus symbol. The bonus symbol moves from game symbol to game symbol temporarily changing the game symbol to a bonus symbol. If the change results in a winning combination, the player receives an award.

Known gaming machines also have a random generation and a player selection. For instance, one known gaming machine provides a player one or more opportunities to select masked bonus awards from a group of masked awards displayed to the player. When the player selects a masked award, the player receives the value of the award, the game displays a message that the player may continue and enables the player to select another masked award. The player selects another masked award, and the sequence continues until the player selects a masked terminator. European Patent Application No. EP 0 945 837 A2 discloses such a game.

Known gaming machines have a plurality of random generations, a player selection and a player decision. For instance, one game allows players to accept or decline multiple award offers. The TOP DOLLAR® gaming device, which is manufactured and distributed by the assignee of this application, provides the player with three offers and a final award. When an offer is given, the player may accept or reject it by pushing an accept button or a reject button, respectively. If the player accepts an offer, the player receives the accepted bonus amount and the bonus round terminates. If the player declines an offer, the game generates another offer for the player. The final award is automatically provided to the player.

In each of these games, the random selections do not accumulate; rather, they are evaluated independently. That is, the roaming wildcard game has only one random generation, wherein the game randomly generates a plurality of symbols, which determine whether the roaming wildcard produces winning combinations. In the select until game, the player's picks are evaluated individually, whereby a single uncovered game terminator ends the game. In the offer acceptance game, the player evaluates the outcome of a single random generation to determine whether to keep the outcome or risk a swap.

SUMMARY OF THE INVENTION

The present invention includes a gaming device which displays a plurality of choices or selections to a player, whereby each choice generates or provides an associated number of points. In one embodiment, the points equal awards that the game provides to the player. The game provides an initial number of picks to the player. The game also maintains a regeneration amount, whereby the player receives a new number of picks if the points or awards associated with the player's choices or picks accumulate at least to the regeneration amount, within the initial number of picks.

The gaming device of the present invention also includes a plurality of point tables which include the points that the processor associates with the choices or picks. The processor of the gaming device accumulates the total points, which is the sum of all points associated with the player's choices or picks.

The processor also maintains a goal amount of points. The game provides an award to the player when the player achieves the goal or goal amount. This award is in addition to awards achieved when the player generates points (in the embodiment where the points equal awards).

The game preferably selects and uses a point table from a plurality of point tables, wherein the selected point table is associated with a percentage of the goal achieved. The percentage is the player's total points divided by the goal amount of points. That is, as the player accumulates points, the percentage of the goal amount increases. The processor then chooses a point table from the plurality of point tables based on the current percentage. The game maintains certain percent ranges, such as 0–15%, 16–30%, etc., whereby the game maintains a different point table for each range. The present invention further includes a plurality of point tables for each range, wherein the game randomly chooses one of the tables when the player accumulates enough points to enter a range.

The present invention includes a preferred method for operating the gaming device. In this method, the game displays a plurality of choices and provides a number of picks to a player. The game prompts the player to pick a choice and, upon a pick, sends a corresponding input to the processor. The game provides an associated number of points to the player and adds the points to any previously accumulated points, to form a total number of points. The game adds the pick to any previously accumulated picks to form a total number of picks.

The game determines if the total number of points is equal or greater than a regeneration amount and if the total picks equals the number of provided picks. The game provides a new number or set of picks if the total number of points is equal to or greater than the regeneration amount. The game prompts the player to pick a new choice if the total number of picks is less than the number of provided picks and the total number of points is less than the regeneration amount. The game ends if the total number of picks equals the number of provided picks and the total number of points is less than the regeneration amount.

The present invention includes an alternative method associated with the operation of the gaming device. In this method, the game displays a plurality of choices on a display device. The processor maintains a plurality of point tables, wherein the point tables include points associated with the choices or picks. The processor accumulates a total number of points via the player's picks. The processor maintains a goal amount and assigns a point table to each choice or pick based on a percentage, wherein the percentage equals the total number of points divided by the goal amount. The processor prompts the player to make a choice and upon receiving an input, provides points from the assigned point table. The points preferably equal awards for the player.

It is therefore an advantage of the present invention to provide a gaming device having a number of picks and a regeneration amount, wherein the game regenerates the number of picks if the player accumulates the regeneration amount of points within the initially provided number of picks.

Another advantage of the present invention is that the gaming device maintains a goal amount and accumulates a player's points, whereby the accumulated points divided by the goal amount form a percentage, and whereby the game selects a point table based on the current percentage.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE DRAWINGS

FIGS. 4A through 4F are schematic views of point or award pools of one embodiment of the present invention, which include points or awards that the game assigns to the game's choices or the player's picks.

FIGS. 5A through 5F are schematic views of the point or award pools of FIGS. 4A through 4F, which additionally include a consolation award and an associated likelihood of obtaining the consolation award.

FIG. 7 is a schematic view of an alternative stage table that illustrates a plurality of stages and success percentage associated with each stage, wherein the success percentage is the likelihood that the game generates an advance versus a no advance outcome.

DETAILED DESCRIPTION OF THE INVENTION

Gaming Device and Electronics

Figure 1A:
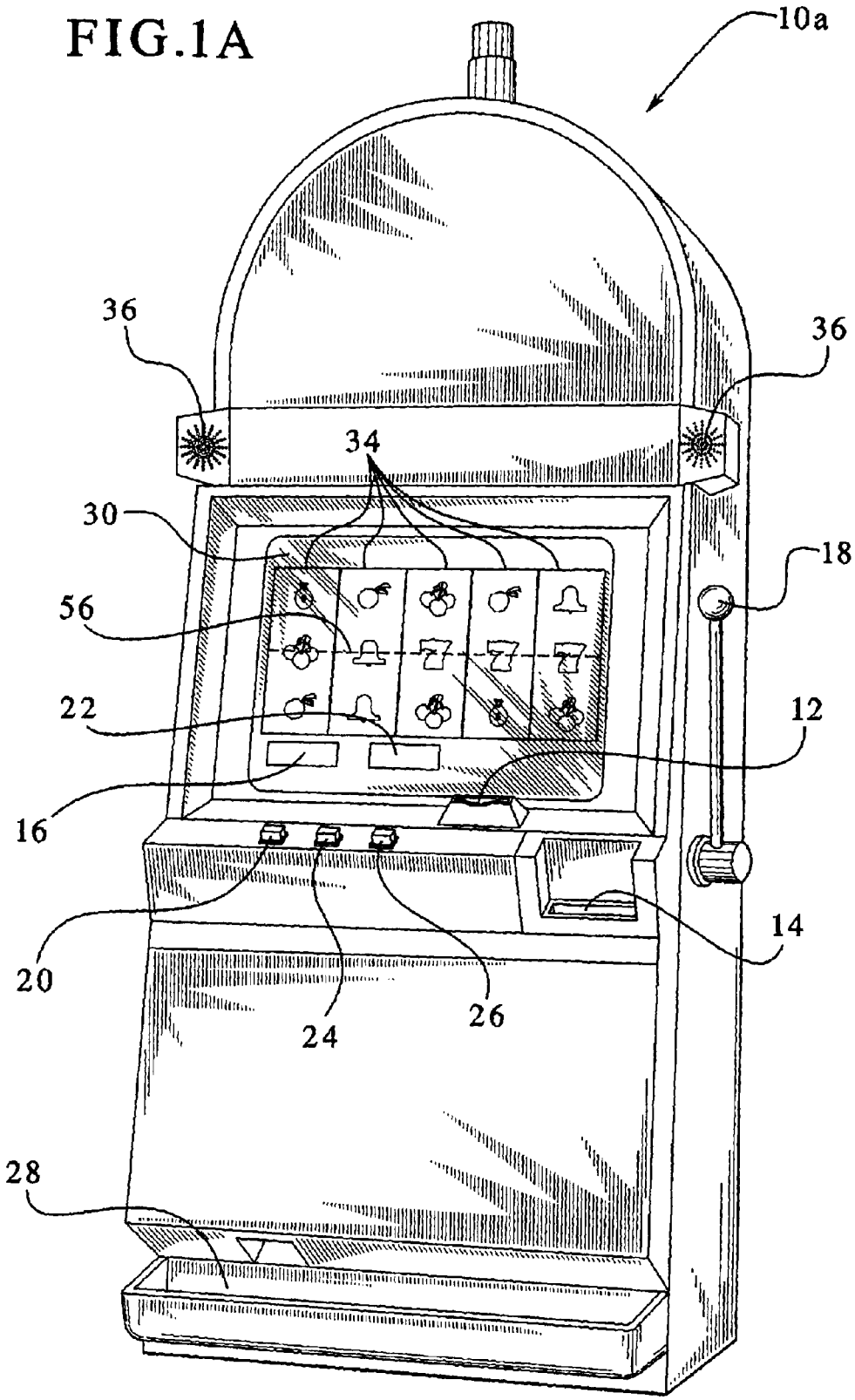
FIG. 1A is a front-side perspective view of one embodiment of the gaming device of the present invention.
Figure 1B:
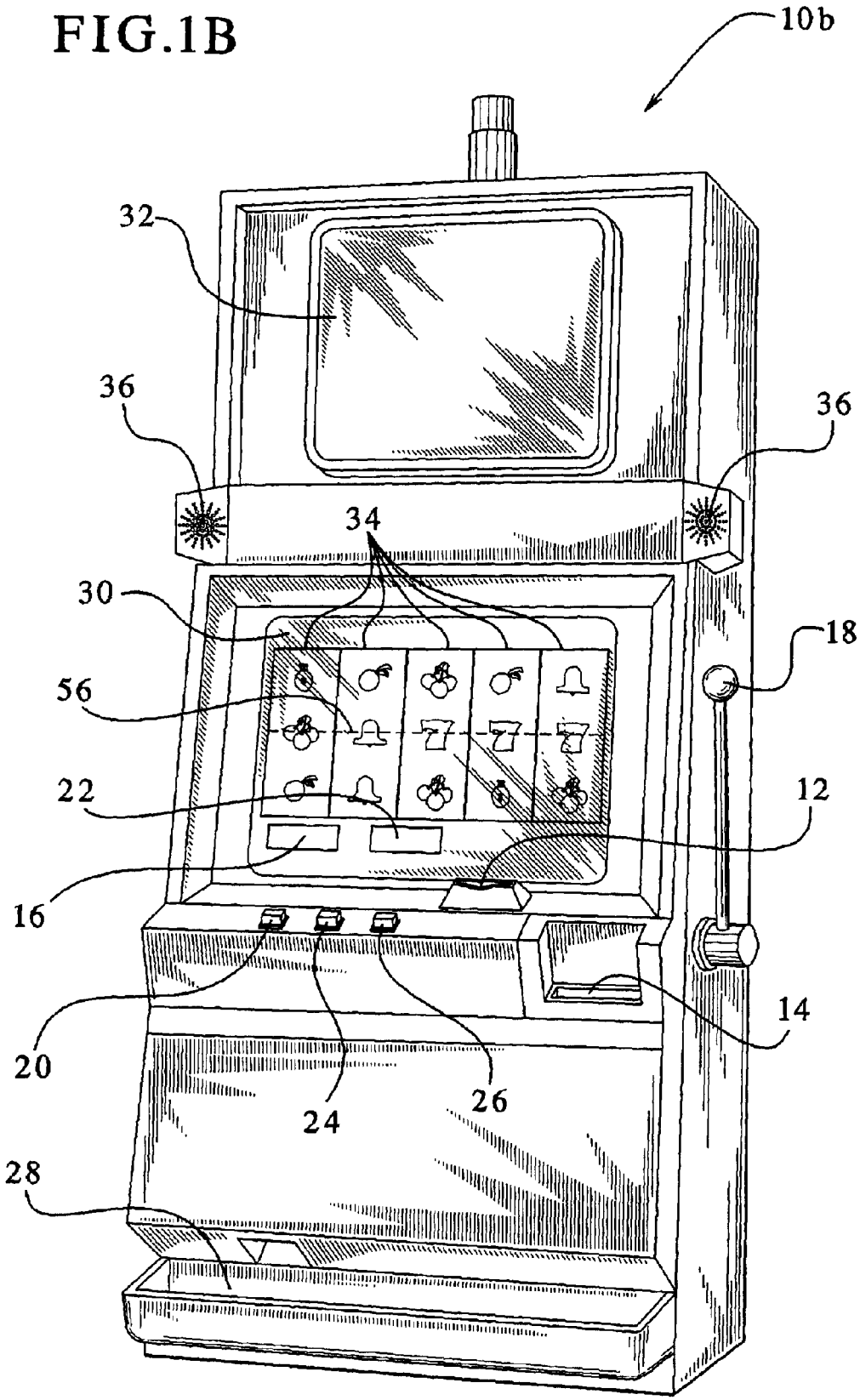
FIG. 1B is a front-side perspective view of another embodiment of the gaming device of the present invention.

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10. Gaming device 10 is preferably a slot machine having the controls, displays and features of a conventional slot machine. It is constructed so that a player can operate it while standing or sitting, and gaming device 10 is preferably mounted on a console. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any primary game such as slot, poker or keno, any of their bonus triggering events and any of their bonus round games. The symbols and indicia used on and in gaming device 10 may be in mechanical, electrical or video form.

As illustrated in FIGS. 1A and 1B, gaming device 10 includes a coin slot 12 and bill acceptor 14 where the player inserts money, coins or tokens. The player can place coins in the coin slot 12 or paper money or a ticket voucher in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player, which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

At any time during the game, a player may "cash out" and thereby receive a number of coins corresponding to the number of remaining credits by pushing a cash out button 26. When the player "cashes out," the player receives the coins in a coin payout tray 28. The gaming device 10 may employ other payout mechanisms such as credit vouchers redeemable by a cashier or electronically recordable cards, which keep track of the player's credits.

Gaming device 10 also includes one or more display devices. The embodiment shown in FIG. 1A includes a central display device 30, and the alternative embodiment shown in FIG. 1B includes a central display device 30 as well as an upper display device 32. Gaming device 10 preferably displays a plurality of reels 34, preferably three to five reels 34 in mechanical or video form at one or more of the display devices. However, it should be appreciated that the display devices can display any visual representation or exhibition, including but not limited to movement of physical objects such as mechanical reels and wheels, dynamic lighting and video images. A display device can be any viewing surface such as glass, a video monitor or screen, a liquid crystal display or any other static or dynamic display mechanism. If the reels 34 are in video form, the display device for the video reels 34 is preferably a video monitor.

Each reel 34 displays a plurality of indicia such as bells, hearts, fruits, numbers, letters, bars or other images which preferably correspond to a theme associated with the gaming device 10. Furthermore, gaming device 10 preferably includes speakers 36 for making sounds or playing music.

Figure 2:
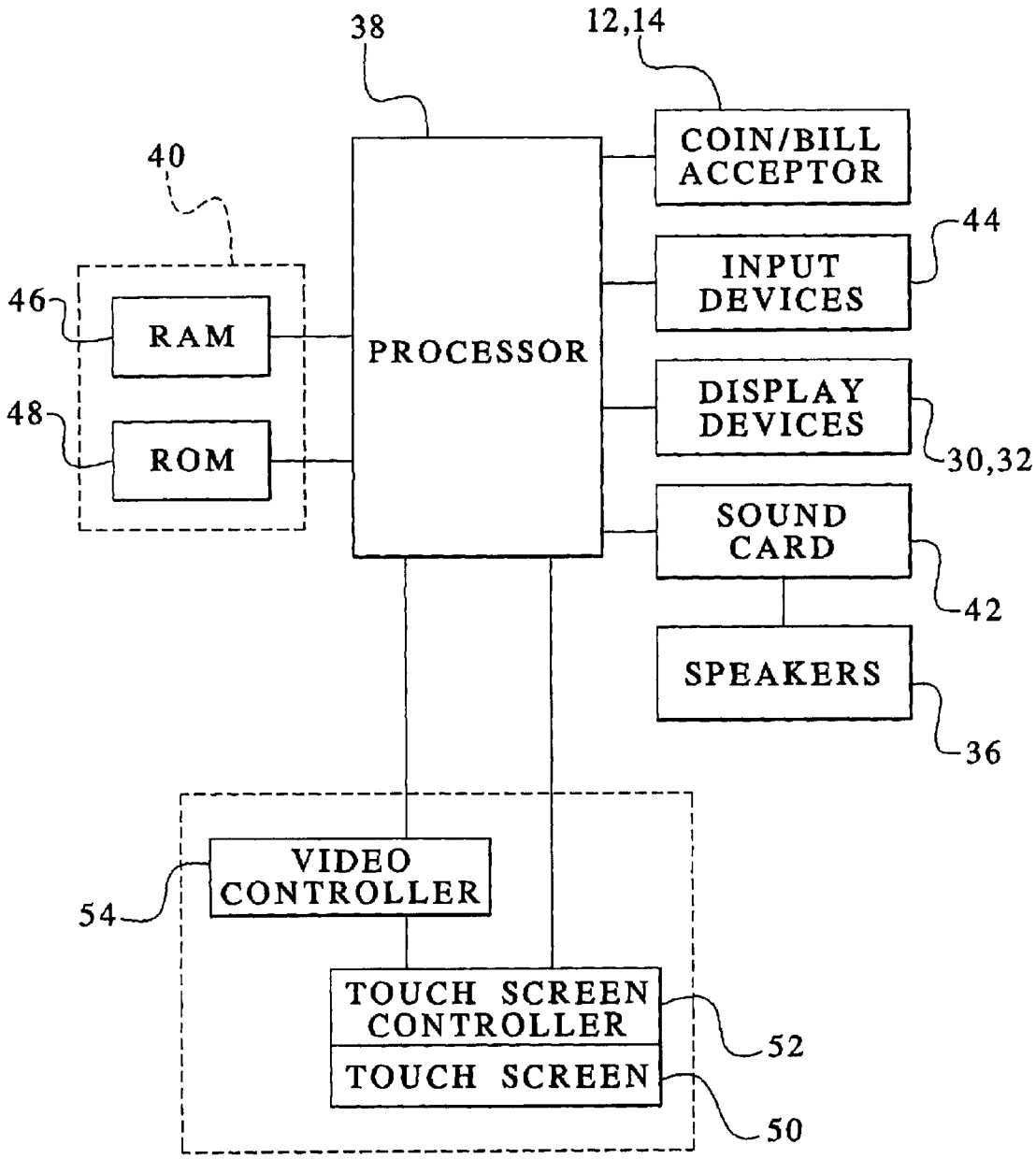
FIG. 2 is a schematic block diagram of the electronic configuration of one embodiment of the gaming device of the present invention.

As illustrated in FIG. 2, the general electronic configuration of gaming device 10 preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 is generally referred to herein as the "computer" or the "controller."

With reference to FIGS. 1A, 1B and 2, to operate the gaming device 10 in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, preferably gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on a display device. The gaming device 10 preferably uses a video-based central display device 30 to enable the player to play the bonus round. Preferably, the qualifying condition is a predetermined combination of indicia appearing on a plurality of reels 34. As illustrated in the five reel slot game shown in FIGS. 1A and 1B, the qualifying condition could be the number seven appearing on three adjacent reels 34 along a payline 56. It should be appreciated that the present invention can include one or more paylines, such as payline 56, wherein the paylines can be horizontal, diagonal or any combination thereof.

Choices and Databases

Figure 3:
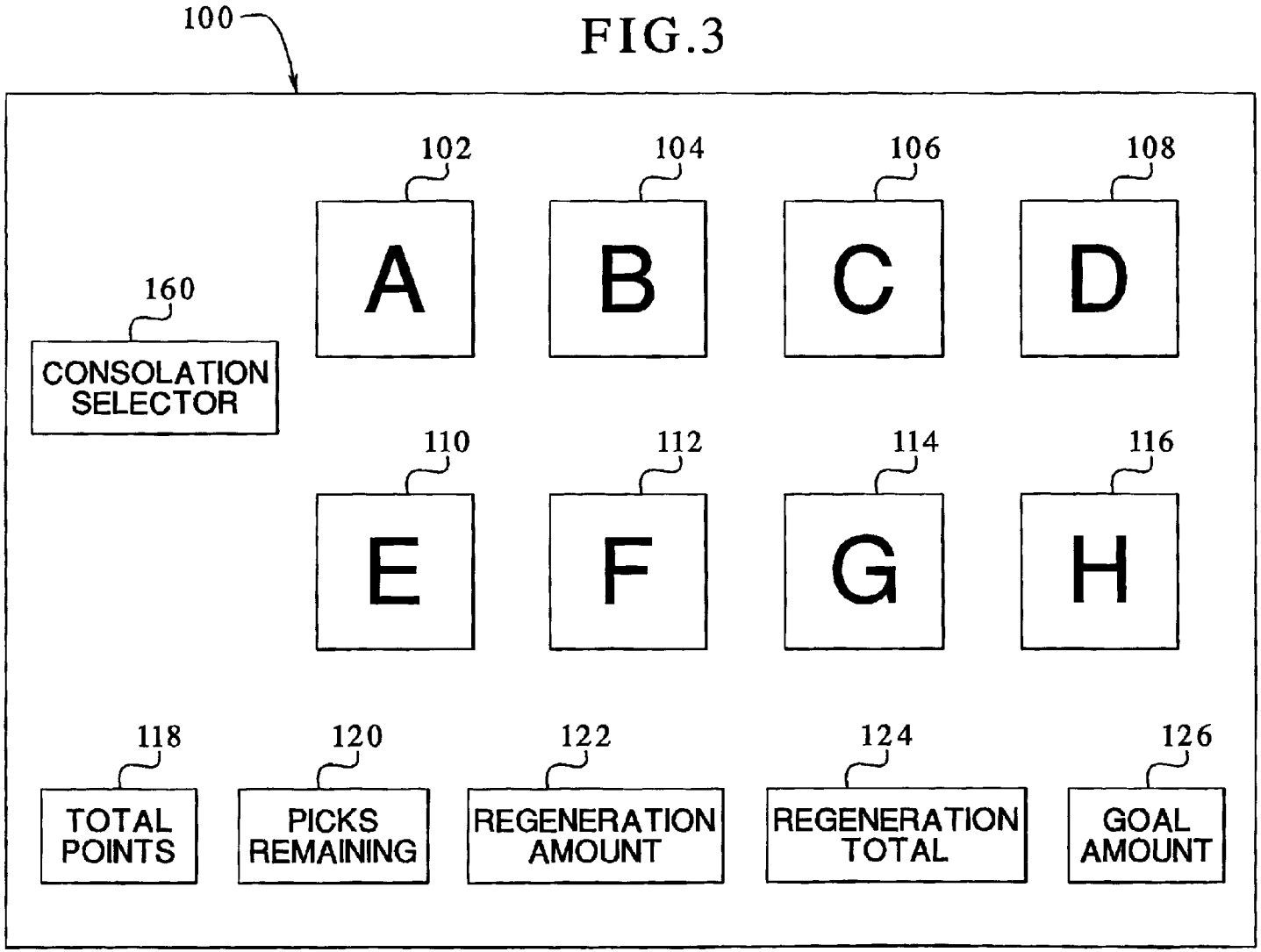
FIG. 3 is a front elevational view of one of the display devices of FIGS. 1A and 1B illustrating one embodiment of the present invention.
Figure 6A:
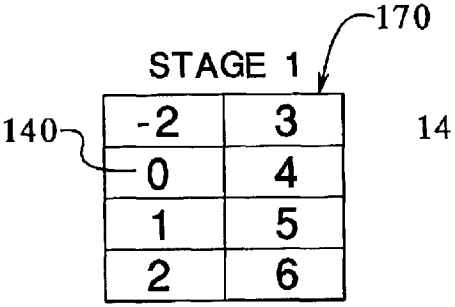
FIGS. 6A through 6H are schematic views of stage tables, which include points or awards that the game assigns to the game's choices or player's picks.
Figure 6B:
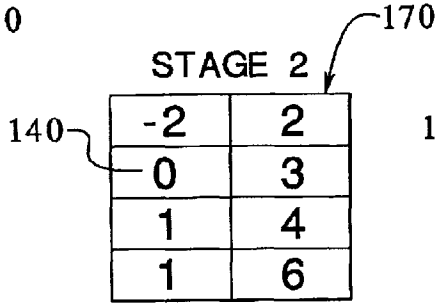
Figure 6C:
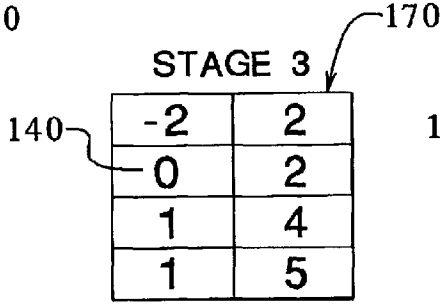
Figure 6D:
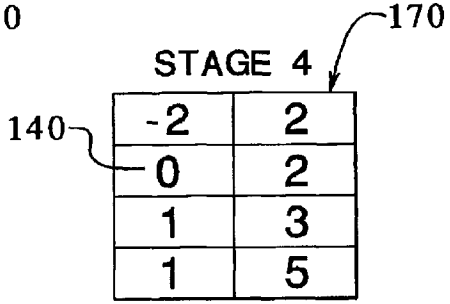
Figure 6E:
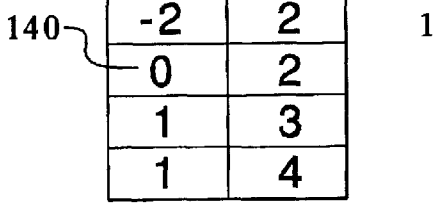
Figure 6F:
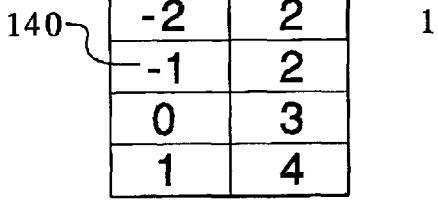
Figure 6G:
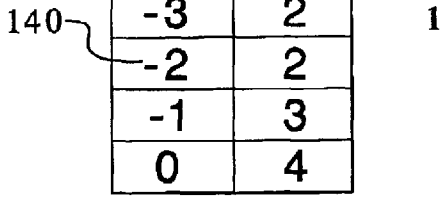
Figure 6H:
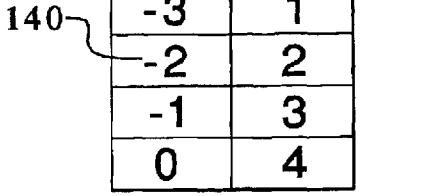

Referring now to FIG. 3, the display 100 of the gaming machine includes a plurality of player selectable choices 102, 104, 106, 108, 110, 112, 114 and 116. The display 100 includes eight choices, however, the present invention contemplates any suitable number of choices. The choices 102, 104, 106, 108, 110, 112, 114 and 116 are preferably areas of a touch screen 50 such that when the game enables an input to be made to the processor 38 of FIG. 2, a player may touch and pick any of the choices and thereby send a discrete input to the processor 38. The game does not always enable the inputs, so that when the input is not enabled and the player touches a choice, the game does not send an input. The game enables the input at the appropriate time of a sequence, as described below.

The choices 102, 104, 106, 108, 110, 112, 114 and 116 preferably include suitable indicia, here the letters "A" through "H," respectively, which designate one choice from another. The choices and their accompanying indicia may alternatively be electromechanical input devices mounted to the gaming device 10, similar to the play button 20, the bet one button 24 and the cash out button 26 illustrated in FIGS. 1A and 1B. The choices in electromechanical form display their identifying indicia in any suitable manner, such as a including a light source behind the devices.

The display 100 preferably includes a total points indicator 118, a picks remaining indicator 120, a regeneration amount indicator 122, a regeneration total indicator 124 and a goal amount indicator 126. The indicators 118, 120 and 124 are preferably areas of a video monitor display device 30 or 32 adapted such that when the processor 38 (FIG. 2) updates the player's points or receives an input from a pick, the indicators convert and display an updated signal from the processor.

More specifically, the total points indicator 118 receives updated point or award signals, translates the signals and displays the player's total updated points or awards as the player picks choices and accumulates their associated points or awards.

The picks remaining indicator 120 receives updated award signals, translates the signals and displays the player's remaining picks as the player picks choices. As discussed below, the game provides a number or set of picks to the player, such as four picks. As the player makes the picks, the processor preferably counts backward from the original number or forward from zero, and the picks remaining indicator 120 displays this count.

The regeneration amount indicator 122 and the goal amount indicator 126 are preferably static displays in a single game of the present invention. The present invention contemplates providing a new set of picks or resetting the number of picks if the player accumulates a predetermined amount of points or awards within the number or set of provided picks. The regeneration amount indicator 122 displays the number of points or awards necessary to generate a new set of picks or reset the number of picks.

The regeneration amount preferably does not change in a game of the present invention, although the present invention includes different regeneration amounts in different games. In one example, the regeneration amount is initially set to ten points or awards and stays the same throughout the game. Alternatively, the regeneration amount varies throughout the course of the game. In an example wherein the amount varies, the regeneration amount is initially set to ten points or awards and, at a later point in the game, changes to twenty points or awards. The regeneration amount indicator 122 displays the current regeneration amount and accordingly updates and displays any change.

The regeneration total indicator 124 receives updated award signals, translates the signals and displays the player's regeneration points or awards as the player picks choices and accumulates their associated points or awards. The player's regeneration total is the amount of points or awards that the player has received since the game provided a new set of picks. If the player's regeneration total displayed by indicator 124 meets or exceeds the regeneration amount 122, within the number or set of provided picks, the player receives a new set of picks, and the game resets the regeneration total of the indicator 124 to zero. Accordingly, if the player successfully reaches the goal amount, the game can provide the player with an additional bonus game, where the player can accommodate additional bonus awards.

The present invention contemplates providing a goal award after a player achieves an amount of points or awards equal to a goal amount. The goal award includes any award desired by the implementor, such as a number of game credits, game credit modifiers such as multipliers or a number of picks from a prize pool. The goal amount indicator 126 displays the goal amount. The goal amount preferably does not change in a game of the present invention, although the present invention includes different goal amounts in different games. In an example, the goal amount is initially set to one hundred points or awards and stays the same throughout the game.

In an alternative embodiment, gaming device 10 repeats the game after the player achieves an amount of points or awards equal to the goal amount. In the repeated game, the gaming device, in one embodiment, provides higher average awards and also makes it more difficult for the player's regeneration total to reach the regeneration amount 122 within the number of picks provided. In this embodiment, therefore, gaming device 10 may be adapted to issue, for example, two or more awards for every point that the player accumulates.

Alternatively, the goal amount varies throughout the course of the game. In one example, the goal amount is initially set to one hundred points or awards and changes to one hundred twenty if the player's regeneration total equals the regeneration amount one or more times. In another example, the goal amount is initially set to one hundred points or awards, the player achieves the goal amount and the goal award and the game starts over, wherein the goal amount is now two hundred points or awards. It should also be appreciated that the game can restart with the same goal amount as the first game. Accordingly, if the player is successful by reaching the goal amount, the game can provide the player with an additional bonus game where the player can accumulate additional bonus awards. The goal amount indicator 126 displays the goal amount and accordingly updates and displays any change.

The indicators 118, 120, 122, 124 and 126 may alternatively be electromechanical display devices mounted to the gaming device 10. Such electromechanical indicators are electrically connected to the processor 38 (See FIG. 2) such that they receive signals from the processor, display their identifying indicia in any suitable manner, translate the signals from the processor and display the appropriate amount.

Figure 8:
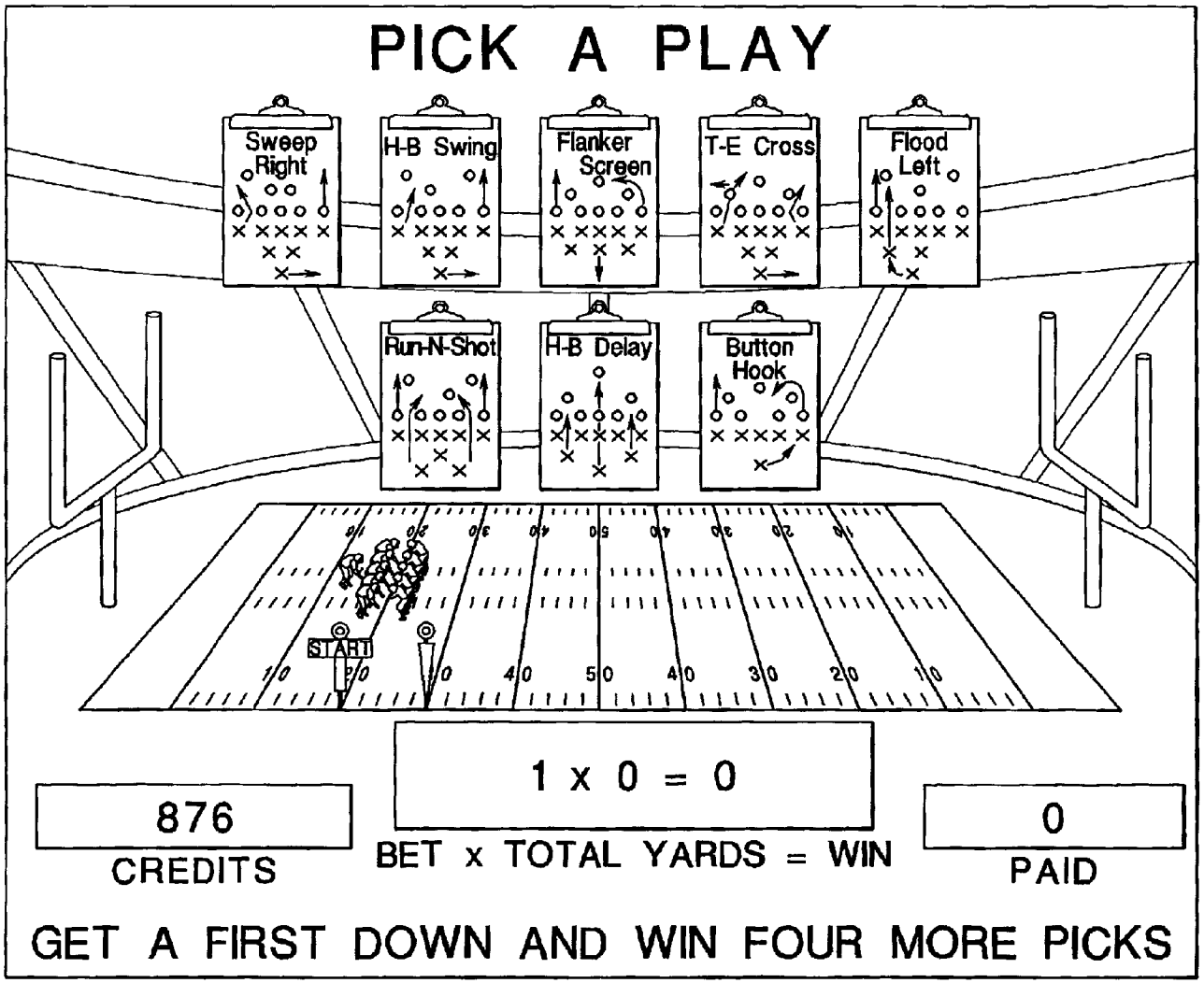
FIG. 8 is a graphical display of one example of one embodiment of the present invention.

Further alternatively, the regeneration amount indicator 122 and the goal amount indicator 126 include any implicit or explicit, static or dynamic displays that communicate the regeneration amount and goal amount, respectively. For example, one embodiment of the present invention is implemented in a football theme, wherein the regeneration amount indicator 122 is a message on the display device stating "GET A FIRST DOWN AND WIN FOUR MORE PICKS" as illustrated in FIG. 8. A player familiar with football knows that ten yards yields a first down and therefore knows or soon discovers that the regeneration amount is ten points or awards. In the same football example, the goal amount indicator 126 may message on the display device stating, in effect, "Score a touchdown and win a touchdown award." A player familiar with football knows that starting from a known yard-line, a touchdown requires one hundred points or awards less the player's current position on the field. A player starting on the twenty yard line therefore knows that the goal amount is eighty points or awards. In this implementation, the player accumulates awards as the player travels down the field, the points equal awards and the player wins the goal award if the player obtains a touchdown. If points do not equal awards, the player only wins the goal award. It should also be appreciated that awards could be provided to the player for achieving the regeneration amounts and that consolation awards could be provided to the player for not achieving the regeneration amount after the player uses all of the player's picks.

Referring now to FIGS. 4A through 4F, point or award pools 126, 128, 130, 132, 134 and 136 include awards that the game assigns to the choices of FIG. 3. In an embodiment where points equal awards provided to the player, the awards of the present invention include any item or number that translates into a pecuniary gain for the player. The awards, including the goal award, include gaming device credits and modifiers such as multipliers, wherein the multipliers multiply a tally of gaming device credits, such as the amount of a player's total bet, bet per payline, total win, win per payline or win from a bonus round game. The awards also include other types, such as a number of picks from a prize pool, wherein the prize pool includes, for example, gaming device credits.

The point or award pools 126, 128, 130, 132, 134 and 136 each include eight point totals or awards 140, wherein the game preferably randomly assigns each point total or award to one of the choices 102 through 116 (FIG. 3). The award pools alternatively include more point totals or awards 140 than choices, whereby the game does not assign one or more of the point totals or awards. The point or award pools further alternatively include less point totals or awards 140 than choices, whereby the game assigns one or more of the point totals or awards a plurality of times. The point or award pools still further alternatively include different amounts of point totals or awards such as one award pool having less point totals or awards than choices, one award pool having the same number and one award pool having more point totals or awards than choices.

The point or award pools 126 through 136 each include a percent range 142. The percent ranges 142 include percentages that correspond to the player's total accumulated points or awards, as indicated by the total point indicator 118, divided by the goal amount, as indicated by the goal amount indicator 126. In one embodiment, after the player's previous selection and before the game enables a further pick, the game determines the percentage, as described above, and selects the database having the percent range 142 that includes the determined percentage.

In one example of this embodiment, if the player's total points or awards after a previous selection is 40, as indicated by the total points indicator 118, and the goal award is 80, as indicated by the goal award indicator 126, the game determines the percentage to be 50%. The game selects the point or award pool 132 of FIG. 4D because its percent range 142 is 45% to 60% and therefore includes the determined percentage (i.e., 50%). The player's next pick therefore yields one of the point tables or awards from the award pool 132.

It should be appreciated that in an embodiment in which the number of point or award pools is equal to or less than the number of choices, each point or award pool may include a different percent range 142. In an embodiment in which the number of point or award pools is greater than the number of choices, one or more point or award pools may have overlapping percent ranges 142. Where two point or award pools include the same determined percentage, the game preferably randomly selects one of the point or award pools.

In this embodiment, the game randomly assigns the point tables or awards 140 of the appropriate point or award pool to the choices and masks the assignments from the player. In one embodiment, the game randomly assigns each point total or award 140 to a choice and maintains the assignment. For example, if the player has a total award of 40 and a goal amount percentage of 50%, the game employs the database 132. The game randomly assigns, for example: the 20 to the "B" choice 104; the −4 to the "D" choice 108; the 5 to the "F" choice 112; the 3 to the "E" choice 110; the 1 to the "A" choice 102; the 0 to the "H" choice 116; the −2 to the "G" choice 114 and the 2 to the "C" choice 106.

In this embodiment, the game only enables the player to select each choice once. The player selects the "A" and obtains the 1 point award. The player's total points or awards is now 41, and the goal amount percentage is still within the range of database 132. If the player has picks remaining, the game employs the same database 132 and preferably the same random generation as above, whereby the "A" is no longer selectable. The player selects the "G" and obtains −2 points or awards. The player's total points or awards is now 39, and the goal amount percentage is still within the range of database 132. If the player has picks remaining, this embodiment of the game employs the same database 132 and the same random generation as above, whereby the "A" and "G" are no longer selectable. Assigning each choice a point total or award 140 is preferred because when the player runs out of picks, the game preferably reveals the points or awards of the unselected choices and shows the player the picks that would have enabled the player to advance or obtain a goal award.

In an alternative embodiment, the same pool or database can be employed until the player uses all of the players picks before obtaining the regeneration amount or the player reaches the regeneration amount. For example, if the goal amount is 100, the regeneration amount is initially 35, the initial regeneration total is 25 and the player has four picks, the game will assign the points or awards from a single pool such as pool 128 (FIG. 4B) to the selections 102 to 116. If the player picks selection 104 or "B," and 7 points are associated with that selection, the regeneration total will be 32. Since the regeneration total does not equal the regeneration amount, the player picks another selection. The possible points or awards associated with the selections are still taken from pool 128 or remain as associated before the player's first pick because even though the percentage is now greater than 30 (i.e., 32%), the regeneration amount was not achieved and the player still has picks remaining.

In another alternative embodiment, the game randomly selects the points or awards that the player receives either up front or as the player picks choices. For example, a game employing the point or award pool 126 of FIG. 4A either randomly generates that the player receives "two" points or awards first, "one" point or award second, "six" points or awards third, etc., before the player makes any picks. Or, the player picks a first time and the game randomly generates "two" points or awards, the player picks a second time and the game randomly generates "one" point or award, the player picks a third time and the game randomly generates "six" points or awards, etc. In both cases, the choice the player picks is irrelevant to the result, i.e., picking any choice "A" through "H" yields the same result. This embodiment enables the generation of the same points or awards two or more times. This embodiment also enables the player to pick the same choice as many times as the player desires.

If the player exhausts the provided picks without generating a regeneration amount of points or awards, the game ends. That is, if the picks remaining indicator reaches zero before the regeneration total of the indicator 124 meets or exceeds the regeneration amount 122, the game ends. If the player generates the regeneration amount 122 before exhausting the provided picks, the player obtains a new or regenerated set of picks and the game accordingly resets the picks remaining indicator 120 and resets the regeneration total of the indicator 124.

In the embodiment described above, the game concurrently evaluates the player's total points or awards, as described above, to determine a goal amount percentage and the appropriate point or award pool. The dual evaluations create one scenario, in which the player achieves the regeneration amount and thus a new set of picks, but does not enter a new percent range 142. In this scenario, the game preferably employs the same point or award pool (e.g., 126 through 136) for two consecutive sets of picks. In the other embodiment described above, the pool is only changed when the regeneration amount is reached.

The dual evaluations create a second scenario in which the player achieves a point or award total that invokes a new percent range 142, but does not achieve the regeneration amount. In this scenario, the present invention includes two alternatives. In one alternative as described above, the game selects and employs the updated point or award pool having the percent range 142 that includes the newly determined percentage and randomly assigns the updated points or awards 140 to the choices. The player picks from the unselected and updated choices and attempts to regenerate a new set of picks. In the other alternative as described above, the game continues with the existing point or award pool having the percent range 142, which is less than the determined percentage. The game updates the point or award pool to reflect the determined percentage upon the regeneration of a new set of picks.

Consolation Embodiment

Referring now to FIGS. 5A through 5F, the present invention contemplates enabling a player to try for a consolation award 144 in the event that the player determines it is unlikely that the player's regeneration total will meet or exceed the regeneration amount before exhausting the provided picks. FIGS. 5A through 5F include the point or award pools 146, 148, 150, 152, 154 and 156, respectively, which are the pools 126 through 136 of FIG. 4 plus an associated consolation award 144 and an associated success percentage 158.

The consolation awards 144 include any amount desired by the implementor, are preferably different from one database to the next as illustrated, but alternatively may be the same for each database. The success percentages 158 which indicate a likelihood of obtaining the consolation award include any percentage desired by the implementor and are preferably different from one database to the next, but alternatively may be the same for each database. In FIGS. 5A through 5F, the consolation awards decrease as the percent ranges 142 increase. The success percentages 158 increase as the percent ranges 142 increase. In essence, the earlier in the game that the player attempts a consolation award 144, the less the success probability but the higher the consolation award. The present invention alternatively includes any value and success distribution desired by the game implementor.

Referring again to FIG. 3, a consolation choice 160, similar in form and structure to the choices 102 to 116, enables a player to stop an attempt to accumulate a regeneration amount and try for a consolation award. An astute player tries to accumulate awards until only one pick remains, as indicated in the picks remaining indicator 120. If on the last pick, it appears unlikely that the player will generate the regeneration amount (i.e., if the player needs a relatively large number of points or awards to reach the regeneration amount), the player may forego the opportunity to continue the game and opt for a higher value consolation award.

In the football game implementation described above, the consolation award is analogous to a field goal attempt. On fourth down, i.e., with one chance or pick remaining, the game enables the player to select a suitable field goal selection which is the consolation choice 160, which if successful yields a higher consolation value than attempting a fourth down play and not receiving a first down. A player familiar with football knows or soon learns that selecting the consolation choice 160 ends the game of the present invention.

It should be appreciated that the present invention preferably enables the player to select the consolation choice 160 and generate a consolation outcome with any number of picks remaining. It should also be appreciated that alternatively, the game may offer the attempt at a consolation award after the player has used all of the player's picks. It should further be appreciated that the game could change the number of picks when the player has achieved a certain percentage (described above). For example, the game may change the picks from four picks to three picks plus a consolation attempt.

Multiple Stage Embodiment

In the above embodiments, the game enables the player to achieve a point or award total that invokes a new percent range 142 while not achieving the regeneration amount and vice versa. Referring to FIGS. 6A through 6H, the present invention alternatively includes structuring the game to include a preset number of stages having corresponding tables 170, wherein each stage requires the player to achieve the regeneration amount of points or awards in order to advance to the next stage. Each table 170 includes point totals or awards 140 described above in connection with FIGS. 4A through 4F and FIGS. 5A through 5F. As above, the point totals or awards 140 are values that enable the player to advance to the next stage and corresponding table 170 but do not represent awards. Alternatively, the point total or awards 140 are values that enable the player to advance to the next stage and additionally represent awards.

In the embodiment of FIGS. 6A through 6H, the game preferably requires the player to advance through all the stages, e.g., eight stages, before awarding the player the goal award. That is, the game does not require a total amount of points or awards to win the goal award; rather, the player must advance through each stage. For each stage, the player must accumulate a regeneration total of points or awards from the stage's table 170 that meets or exceeds the preset regeneration amount within a defined set of picks to advance to the next stage.

In the tables 170 of FIGS. 6A through 6H, the point totals or awards 140 are chosen such that the player has an increasingly difficult time accumulating a regeneration amount in a provided number of picks. In this configuration, the player has an increasingly difficult time accumulating ten points or awards with four picks, which are the same parameters disclosed above. Also as above, the game randomly associates or assigns the point totals or awards 140 of the tables 170 to the choices 102 though 116 (FIG. 3) and maintains the association throughout the game play of the stage. The game alternatively randomly associates or assigns the point total or awards 140 of the tables 170 to the order in which the player picks choices, i.e., to pick one, pick two, etc.

Referring to FIG. 7, an alternative table 180 including the eight stages of FIGS. 6A through 6H illustrates an alternative method for enabling the player to play the stage by stage embodiment of the present invention. Each stage has an associated success percentage 182, whereby the game generates an advance or a no advance for each stage. The success percentages 182 are preferably high for earlier stages and steadily decrease as the player advances through the stages. Once the game generates an advance or a no advance, the game generates point totals or awards 140 from one or more tables 170 that cumulatively illustrate an advance or no advance outcome to the player. This method enables the game to present exciting scenarios, for example, a zero award, followed by another zero, followed further by a ten award to illustrate an advance outcome.

The embodiment of FIGS. 6A through 6H and FIG. 7 includes awarding the player in a plurality of ways. The game includes only providing a goal award to the player who advances through each of the eight stages. The game includes providing an advancement award to the player each time the player advances through a stage. The advancement award includes being predetermined or being the number of awards 140 accumulated from the table 170 during the play of the stage. The game further includes providing a predetermined advancement award in addition to providing the number of awards 140 accumulated from the table 170 during the play of the stage. Regardless of the award alternative employed, the game preferably provides the goal award after advancing through all the stages.

The alternative embodiment also contemplates providing the consolation award 144 (FIGS. 5A through 5F) at any time by picking the consolation selector or choice 160 (FIG. 3). As disclosed in connection with FIGS. 5A through 5F, the alternative embodiment of FIGS. 6A through 6H includes decreasing, increasing or maintaining the consolation awards in later stages. The alternative embodiment also includes providing success percentages 158 that increase or decrease in later stages. Preferably as above, the earlier in the game that the player attempts a consolation award 144, the less the success probability but the higher the consolation award.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is hereby claimed as follows:

1. A gaming device having a game comprising:

a group of displayed choices;

a point regeneration amount for a first set of selected choices; and a processor which: (a) enables a player to select said first set of said selected choices, determines a number of points associated with each selected choice, and accumulates the points associated with said first set of selected choices; (b) determines whether the accumulated points associated with said first set of selected choices achieves the point regeneration amount for the first set of selected choices; (c) if the accumulated points for the first set of selected choices achieves the point regeneration amount for the first set of selected choices, enables the player to select a second set of selected choices, determines a number of points associated with each selected choice of the second set, and accumulates the points associated with said second set of selected choices; and (d) provides the player an award based on a total of the accumulated points from the first set of selected choices and the second set of selected choices, if any.

2. The gaming device of claim 1, which includes a point regeneration amount for the second set of selected choices, and a third set of selected choices if the accumulated points for the second set achieves the point regeneration amount for the second set.

3. The gaming device of claim 1, which includes a third set of selected choices if the accumulated points for the second set achieves the point regeneration amount for the first set.

4. The gaming device of claim 1, wherein the award is a number of credits equal to the accumulated points generated from first set of selected choices and the second set of selected choices, if any.

5. The gaming device of claim 1, wherein the point regeneration amount for the first set of selected choices is the point regeneration amount for a plurality of sets of selected choices, wherein each of the plurality of sets of selected choices is sequentially provided until accumulated points for one of the sets of selected choices does not achieve said point regeneration amount.

6. The gaming device of claim 5, wherein the award is based on points generated for each of the sets of selected choices.

7. The gaming device of claim 5, which includes an additional award for achieving the point regeneration amount for each of the sets of selected choices.

8. The gaming device of claim 5, wherein each set of selected choices has the same number of selected choices.

9. The gaming device of claim 1, wherein the number of points associated with the selected choices from one of the sets of selected choices is obtained from one of a plurality of point pools.

10. The gaming device of claim 9, wherein each point pool is associated with a percent range, the range determined by the total of the accumulated points divided by a predefined goal amount.

11. The gaming device of claim 10, which includes an additional award provided if the total of the accumulated points achieves the predefined goal amount.

12. The gaming device of claim 10, which includes a repeat of the game if the total of the accumulated points achieve the predefined goal amount.

13. The gaming device of claim 12, wherein the repeated game includes larger awards and wherein the regeneration amounts are more difficult to achieve.

14. The gaming device of claim 1, wherein at least one of the displayed choices is a consolation choice and an associated consolation award opportunity is provided to the player upon the pick of said consolation choice.

15. The gaming device of claim 1, which includes a plurality of sets of selected choices and a plurality of stages, wherein at least one of the sets of selected choices occurs each stage, and wherein an additional award is provided for advancing through each stage.

16. The gaming device of claim 15, wherein advancement in one of the later stages is less likely than an advancement in one of the earlier stages.

17. The gaming device of claim 15, wherein the award is based on the points accumulated in the stages.

18. The gaming device of claim 15, which includes a separate award provided to the player for advancing through one of the stages.

19. The gaming device of claim 15, which includes a separate award provided to the player for advancing through a predefined number of the stages.

20. The gaming device of claim 1, wherein the number of points is a positive number, negative number or zero.

21. A gaming device having a game comprising:

a group of displayed choices;

a number of points associated with each choice;

a point regeneration amount for a first set of selected choices; and a processor which: (a) enables a player to select said first set of said selected choices and accumulates the points associated with said first set of selected choices; (b) determines whether the accumulated points associated with said first set of selected choices achieves the point regeneration amount for the first set of selected choices;

(c) if the accumulated points for the first set of selected choices achieves the point regeneration amount for the first set of selected choices, enables the player to select a second set of selected choices and accumulates the points associated with said second set of selected choices; and (d) provides the player an award based on a total accumulated points from the first set of selected choices and the second set of selected choices, if any.

22. A gaming device having a game comprising:

a display device;

a processor that communicates with the display device;

a plurality of choices displayed by the display device;

a number of points associated with each choice;

means that communicates with the processor for selecting a number of the choices;

an accumulated point total associated with said selected choices;

a goal amount of points; and a first award that is based on the accumulated point total and a second award that is based on whether the accumulated point total meets or exceeds the goal amount of points, wherein the second award is independent of the goal amount of points.

23. The gaming device of claim 22, wherein the first award equals the accumulated point total.

24. The gaming device of claim 22, which includes a plurality of sets of choices and a regeneration amount of points, wherein the player advances to another set of picks if the player accumulates the regeneration amount of points within a number of picks.

25. The gaming device of claim 22, wherein one of the choices yields a consolation award upon a selection of said choice.

26. The gaming device of claim 22, wherein the second award, is a repeat of the game.

27. A gaming device comprising:

a display device;

a processor that communicates with the display device;

a plurality of choices displayed by the display device;

a number of points associated with each choice;

a number of player selections from the choices;

an accumulated point total associated with the choices selected by a player;

an award provided to the player based on the accumulated point total; and a regeneration amount of points, wherein the player obtains a new number of player selections from the choices if the accumulated point total is equal to or greater than the regeneration amount of points within the number of player selections.

28. A method of operating a game of a gaming device, said method comprising the steps of:

(a) displaying a plurality of choices to a player;

(b) providing a set of picks from the choices to the player;

(c) enabling the player to pick one of said choices;

(d) generating a number of points based upon the player's selected choice;

(e) accumulating the number of points in a regeneration total;

(f) providing a new set of picks from the choices if said regeneration total achieves a regeneration amount;

(g) repeating steps (c) to (f) if the regeneration total does not achieve the regeneration amount and at least one of the provided picks remains; and (h) providing the player an award based on the player's selected choices.

29. The method of claim 28, which includes the step of ending the game if the regeneration total does not achieve the regeneration amount and the player has no remaining picks.

30. The method of claim 28, which includes providing at least one award to the player for obtaining one of the points.

31. The method of claim 28, which includes providing a choice having a consolation award, wherein the selection of said choice yields the consolation award and terminates the game.

32. The method of claim 31, wherein the consolation award choice is provided with certain sets of picks.

33. The method of claim 31, wherein the consolation award choice is provided with each set of picks.

34. A method of operating a game of a gaming device, said method comprising the steps of:

(a) accumulating points provided to a player from one or more selections from a displayed group of choices;

(b) determining a percentage of accumulated points of a goal amount of points;

(c) assigning at least one point pool associated with the percentage to the displayed group of choices;

(d) enabling said player to select a choice from said displayed group of choices; and (e) using said point pool to generate a point value upon said player's selection of at least one of the choices from said displayed group of choices.

35. The method of claim 34, wherein the point value is positive, negative or zero.

36. The method of claim 34, which includes adding the point value to a regeneration total and providing a new set of selections to the player if the regeneration total achieves a regeneration amount.

37. The method of claim 36, wherein achieving the regeneration amount is adapted to become increasingly difficult in subsequent sets of selections.

38. The method of claim 36, which includes the step of repeating steps (a) to (e) if said regeneration total does not achieve the regeneration amount and said player has remaining selections.

39. The method of claim 36, which includes the step of ending the game if the regeneration total does not achieve the regeneration amount and said player has no remaining selections.

40. The method of claim 34, which includes the step of providing a goal award to the player if the player's accumulated points achieve the goal amount.

41. The method of claim 34, which includes the step of providing an opportunity for a consolation award to said player if the player selects a consolation choice.

42. The method of claim 41, wherein the opportunity is weighted to yield an award in a percentage of consolation choice selections.

43. A method of operating a game of a gaming device, said method comprising the steps of:

(a) displaying a plurality of choices for a stage of said game;

(b) providing a set of picks of said choices to a player for said stage;

(c) enabling the player to pick a choice;

(d) generating at least one point upon a player's pick of a choice;

(e) accumulating the at least one point in a regeneration total;

(f) decreasing the player's remaining picks;

(g) advancing to another stage if the regeneration total meets or exceeds a regeneration amount; and (h) repeating steps (c) to (g) if said regeneration total does not achieve the regeneration amount and the player has picks remaining in said set.

44. The method of claim 43, which includes the step of ending the game if the regeneration total does not achieve the regeneration amount and the player has no picks remaining in the set.

45. The method of claim 43, which includes the step of providing an additional award to the player if the regeneration total achieves the regeneration amount.

46. The method of claim 43, which includes the step of replaying the game if the regeneration total achieves the regeneration amount.

47. The method of claim 43, which includes the step of enabling the player to advance through a plurality of stages until the player does not generate the regeneration amount in a set of picks.

48. The method of claim 47, which includes the step of providing a goal award to the player if the player advances through a predetermined number of the stages.

49. A gaming device comprising:

a display device;

a processor that communicates with the display device;

a plurality of sets of choices, wherein at least one set of choices is displayed by the display device;

a number of points associated with each choice;

means that communicates with the processor for selecting a number of the choices;

an accumulated point total associated with said selected choices;

a goal amount of points; and a first award based on the accumulated point total and a second award that is based on whether the accumulated point total meets or exceeds the goal amount of points; and a regeneration amount of points, wherein the player advances to another set of choices if the accumulated point total reaches the regeneration amount of points within a number of picks.

50. The gaming device of claim 49, wherein the goal amount of points and the regeneration amount of points are different.

51. A method of operating a game of a gaming device, said method comprising:

accumulating points provided to a player from one or more selections of choices from a displayed group of choices;

determining a percentage of accumulated points of a goal amount of points;

assigning at least one point pool associated with the percentage to the displayed group of choices;

enabling said player to select a choice from said displayed group of choices;

using said point pool to generate a point value upon said player's selection of at least one of the choices from said displayed group; and adding the point value to a regeneration total and providing a new set of selections to the player if the regeneration total achieves a regeneration amount.

52. A method of operating a game of a gaming device, said method comprising:

accumulating points provided to a player from one or more selections of choices from a displayed group of choices;

determining a percentage of accumulated points of a goal amount of points;

assigning at least one point pool associated with the percentage to the displayed group of choices;

enabling said player to select at least one choice from said displayed group of choices;

using said point pool to generate a point value upon said player's selection of at least one of the choices from said displayed group;

adding the point value to a regeneration total and providing a new set of selections to the player if the regeneration total achieves a regeneration amount; and changing a probability of achieving the regeneration amount in at least one subsequent set of selections.

53. The method of claim 52, wherein the regeneration total includes the accumulated points.

54. The method of claim 52, wherein the probability of achieving the regeneration amount decreases in at least one subsequent set of selections.

55. A method of operating a game device, said method comprising:

(a) accumulating points provided to a player from one or more selections of choices from a displayed group of choices;

(b) determining a percentage of accumulated points of a goal amount of points;

(c) assigning at least one point pool associated with the percentage to the displayed group of choices;

(d) enabling said player to select a choice from said displayed group of choices;

(e) using said point pool to generate a point value upon said player's selection of at least one of the choices from said displayed group;

(f) adding the point value to a regeneration total and providing a new set of selections to the player if the regeneration total achieves a regeneration amount; and (g) repeating steps (d) to (f) if said regeneration total does not achieve the regeneration amount and said player has remaining selections.

56. A method of operating a game of a gaming device, said method comprising:

accumulating points provided to a player from one or more selections of choices from a displayed group of choices;

determining a percentage of accumulated points of a goal amount of points;

assigning at least one point pool associated with the percentage to the displayed group of choices;

enabling said player to select a choice from said displayed group of choices; using said point pool to generate a point value upon said player's selection of at least one of the choices from said displayed group;

adding the point value to a regeneration total and providing a new set of selections to the player if the regeneration total achieves a regeneration amount; and ending the game if the regeneration total does not achieve the regeneration amount and said player has no remaining selections.

* * * * *